US008897680B2

(12) United States Patent
Ooishi et al.

(10) Patent No.: US 8,897,680 B2
(45) Date of Patent: Nov. 25, 2014

(54) IMAGE FORMING APPARATUS

(71) Applicants: Akihiko Ooishi, Tokyo (JP); Motoji Kawamoto, Tokyo (JP)

(72) Inventors: Akihiko Ooishi, Tokyo (JP); Motoji Kawamoto, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/938,147

(22) Filed: Jul. 9, 2013

(65) Prior Publication Data

US 2014/0016954 A1 Jan. 16, 2014

(30) Foreign Application Priority Data

Jul. 10, 2012 (JP) ..... 2012-154672

(51) Int. Cl.
*G03G 15/08* (2006.01)

(52) U.S. Cl.
CPC ..... *G03G 15/0856* (2013.01); *G03G 15/0879* (2013.01)
USPC ..... 399/260; 399/27; 399/259; 399/261

(58) Field of Classification Search
USPC ..... 399/27, 259, 260, 261
See application file for complete search history.

(56) References Cited

U.S. PATENT DOCUMENTS 4,463,502 A * 8/1984 Fitzgerald et al. ..... 34/249
5,548,385 A * 8/1996 Takai et al. ..... 399/62
5,619,312 A * 4/1997 Hatano et al. ..... 399/61
5,685,348 A * 11/1997 Wegman et al. ..... 141/2
5,950,054 A * 9/1999 Kim ..... 399/237
6,151,469 A * 11/2000 Lee ..... 399/237
6,466,749 B1 * 10/2002 O'Brien ..... 399/27
6,526,246 B2 * 2/2003 Iwata et al. ..... 399/258
6,587,661 B1 * 7/2003 Shimmura et al. ..... 399/257
7,805,099 B2 * 9/2010 Wayman et al. ..... 399/260
7,813,678 B2 * 10/2010 Wayman ..... 399/260
7,974,557 B2 * 7/2011 Wayman ..... 399/258
8,050,595 B2 * 11/2011 Wayman et al. ..... 399/258
8,532,538 B2 * 9/2013 Inoue ..... 399/255
2005/0163537 A1 * 7/2005 Muramatsu et al. ..... 399/258
2006/0008281 A1 * 1/2006 Matsumoto et al. ..... 399/27
2007/0053721 A1 * 3/2007 Matsumoto et al. ..... 399/258
2007/0231011 A1 * 10/2007 Nose ..... 399/227
2008/0044190 A1 * 2/2008 Silence ..... 399/27
2009/0129792 A1 * 5/2009 Izumi et al. ..... 399/27
2009/0162102 A1 * 6/2009 Wayman ..... 399/259
2009/0162104 A1 * 6/2009 Wayman et al. ..... 399/259
2009/0162105 A1 * 6/2009 Wayman et al. ..... 399/260
2011/0013917 A1 * 1/2011 Hatakeyama et al. ..... 399/27
2011/0052222 A1 * 3/2011 Furuta et al. ..... 399/27
2014/0169805 A1 * 6/2014 Valladares Estrada et al. . 399/27

FOREIGN PATENT DOCUMENTS

JP 2005-250347 9/2005

* cited by examiner

*Primary Examiner* — G. M. Hyder
(74) *Attorney, Agent, or Firm* — Lucas & Mercanti, LLP

(57) ABSTRACT

An image forming apparatus includes: a toner supply section that supplies toner to a plurality of developing sections; a carrier supply section that supplies carrier to the plurality of developing sections; and a control section that controls an operation of the carrier supply section. The carrier supply section includes: a carrier housing section; a carrier distributing section that receives a predetermined amount of carrier that has freely fallen from the carrier housing section and guides the predetermined amount of carrier to each of the plurality of developing sections; a support frame section that slidably supports the carrier distributing section; and a vibration exciter section that vibrates the carrier distributing section.

6 Claims, 13 Drawing Sheets

IMAGE FORMING APPARATUS

CROSS REFERENCE TO RELATED APPLICATIONS

This application is entitled to and claims the benefit of Japanese Patent Application No. 2012-154672, filed on Jul. 10, 2012, the disclosure of which including the specification, drawings and abstract is incorporated herein by reference in its entirety.

BACKGROUND OF THE INVENTION

1. Field of the Invention

The present invention relates to an electrophotographic image forming apparatus, and specifically relates to an image forming apparatus including a developing device with a two-component development system, 2. Description of Related Art In general, an image forming apparatus using electrophotographic process technology (such as a printer, a copy machine, a fax machine) is configured to irradiate (expose) a charged photoconductor with (to) laser light based on image data to form an electrostatic latent image on a surface of the photoconductor. The electrostatic latent image is then visualized by supplying toner to the photoconductor (image bearing member) with the electrostatic latent image formed thereon, whereby a toner image is formed. The toner image is directly or indirectly transferred to a sheet, followed by heating and pressurization for fixing. Consequently, an image is formed on the sheet.

Development systems for forming a toner image on a photoconductor include a one-component development system using only toner as a main component of a developer and a two-component development system using toner and carrier as main components of a developer. In the two-component development system, toner and carrier are mixed and stirred to triboelectrically charge the toner. In order to stably charge the toner, it is ideal that there is no change in surfaces of particles of the carrier.

In a developing device with the two-component development system, toner is consumed in a developing process while carrier is not consumed but remains in the developing device. Thus, mechanical stress and thermal stress due to contact with the toner are accumulated on the carrier, and the carrier particles surfaces are contaminated by adhesion of toner. Temporal degradation of carrier reduces the amount of charge on the toner, resulting in image quality deterioration such as fogging.

To avoid the foregoing problem, a degraded developer in a developing device is periodically replaced. Furthermore, since toner and carrier in a developing device are different from each other in degradation rate, developing devices configured so as to separately supply toner and carrier have been proposed (see, for example, Japanese Patent Application Laid-Open No. 2005-250347 (PTL 1)).

More specifically, PTL 1 discloses a developing device including a carrier supply section that includes a plurality of resupply rollers each including measuring recess portions formed at a peripheral surface thereof, in which carrier put in the measuring recess portions is supplied to respective developing sections by the resupply rollers being rotated. In other words, in the developing device disclosed in PTL 1, carrier is distributed and supplied to a plurality of developing sections by a plurality of resupply rollers.

An image forming apparatus may suffer adherence and/or deposition of carrier to/on members due to changes in chargeability and flow ability of the carrier by the environment (in particular, humidity) inside the apparatus. For example, in the developing device described in PTL 1, carrier may adhere to the measuring recess portions of each resupply roller, which serves as a carrier distributing section, and/or junction sections to join a toner resupply channel positioned immediately below the respective resupply rollers.

However, the developing device in PTL 1 includes no means for preventing adherence of carrier, and thus, cannot prevent temporal adherence and deposition of carrier, resulting in failure of stably resupply of a fixed amount of carrier to each developing section.

As described above, if a fixed amount of carrier cannot be supplied to respective developing sections with good accuracy, the balance between the toner amount and the carrier amount in the developing sections may be lost and the toner may unevenly be charged, which may result in deterioration in image quality.

SUMMARY OF THE INVENTION

An object of the present invention is to provide an image forming apparatus capable of supplying a fixed amount of carrier with good accuracy from one carrier supply section to a plurality of developing sections, enabling maintenance of a stable image quality.

To achieve at least one of the above-mentioned objects, an image forming apparatus reflecting one aspect of the present invention includes: a plurality of developing sections that develop electrostatic latent images respectively formed on a plurality of photoconductors using a developer including a corresponding color toner and carrier to form a toner image; a toner supply section that supplies the corresponding color toners to the plurality of developing sections; a carrier supply section provided separately from the toner supply section, the carrier supply section supplying carrier to the plurality of developing sections; and a control section that controls an operation of the carrier supply section, in which the carrier supply section includes: a carrier housing section that houses the carrier; a carrier distributing section that receives a predetermined amount of carrier that has freely fallen from a carrier supply port of the carrier housing section and guides the predetermined amount of carrier to each of the plurality of developing sections; a support frame section that slidably supports the carrier distributing section; and a vibration exciter section that vibrates the carrier distributing section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described in detail with reference to the accompanying drawings.

Figure 1:
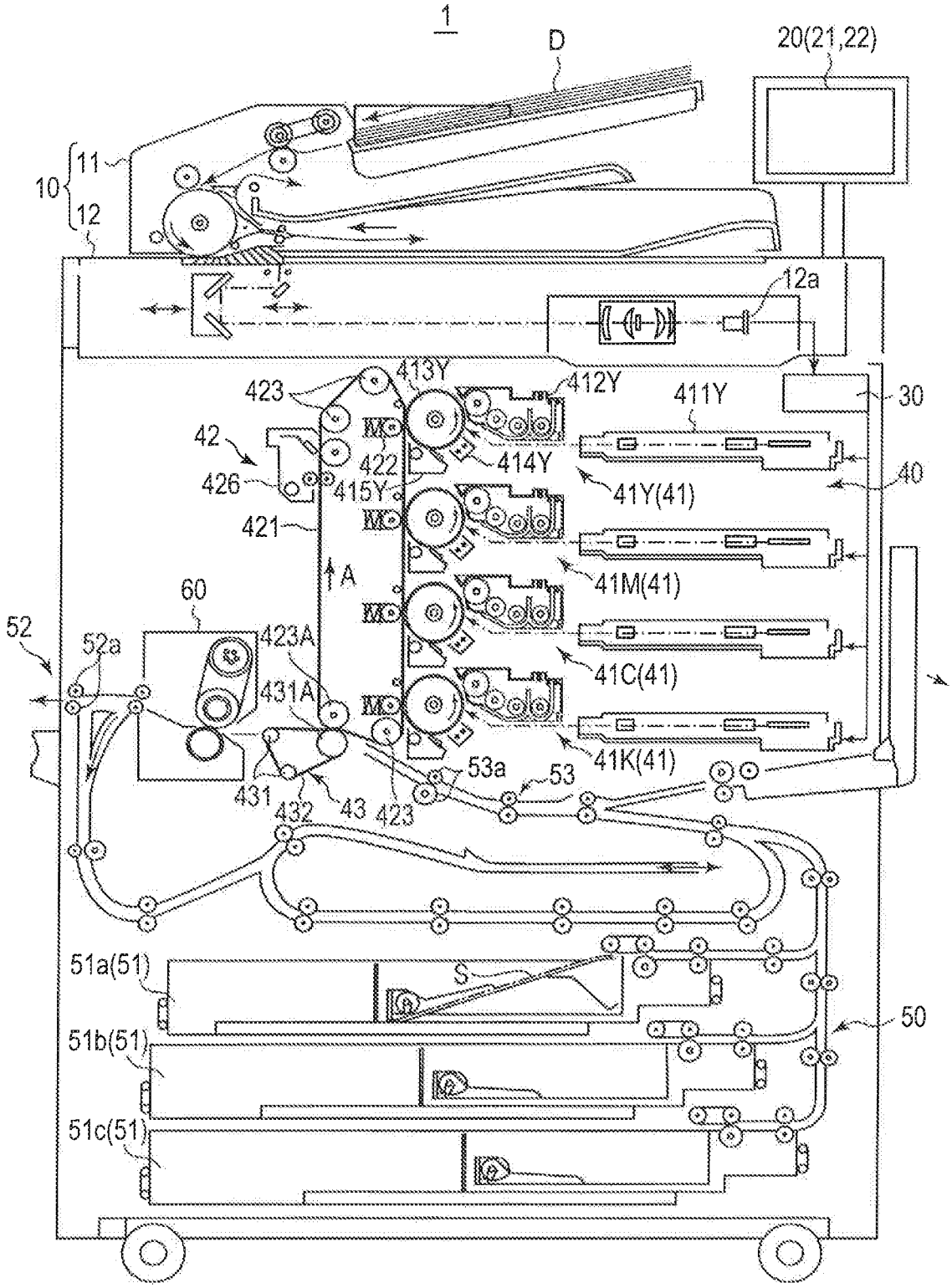
FIG. 1 schematically illustrates an overall configuration of an image forming apparatus according to an embodiment of the present invention.
Figure 2:
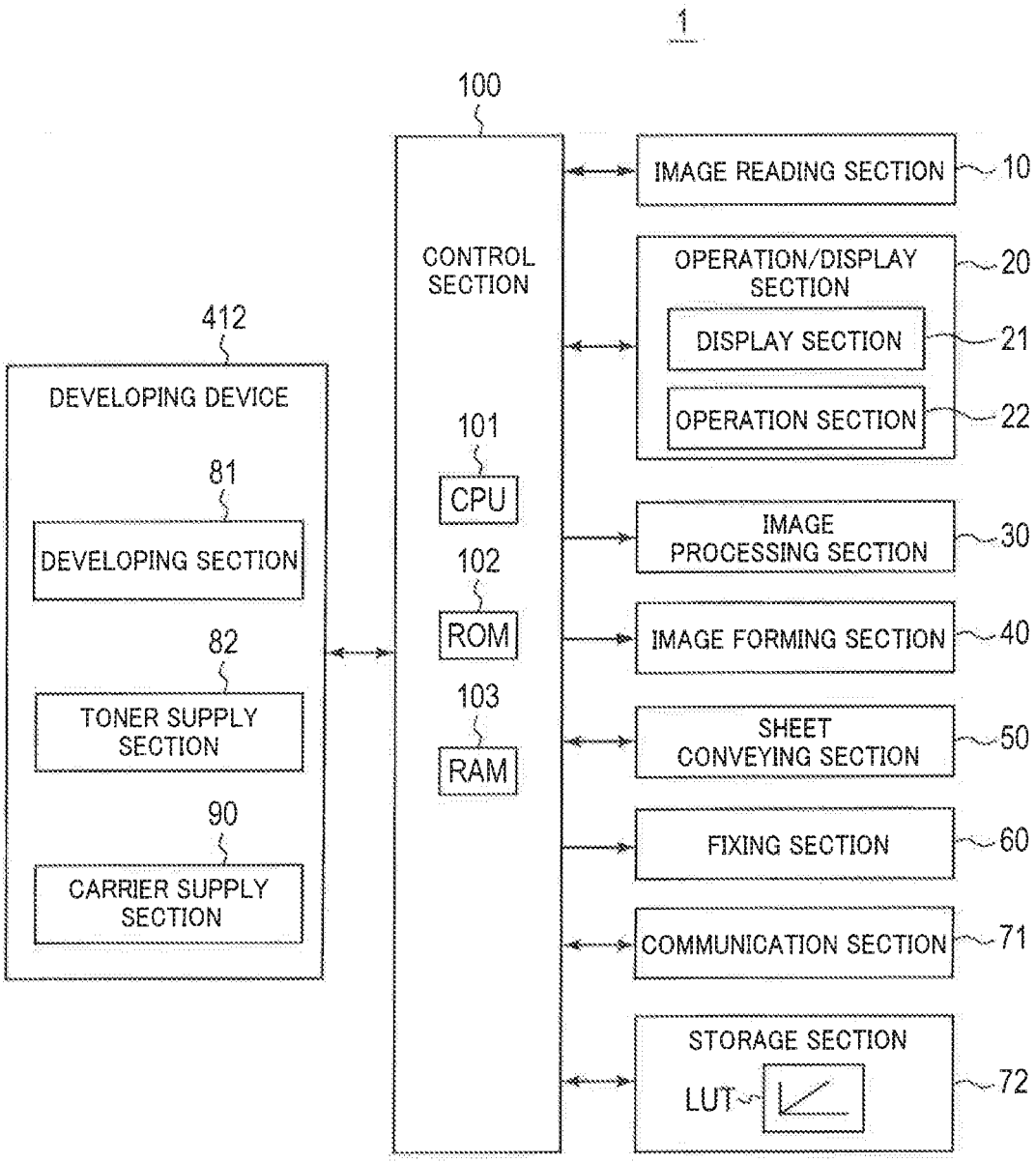
FIG. 2 illustrates a main part of a control system in an image forming apparatus according to an embodiment.

FIG. 1 schematically illustrates an overall configuration of image forming apparatus 1 according to the embodiment of the present invention. FIG. 2 illustrates a principal part of a control system of image forming apparatus 1 according to the embodiment.

Image forming apparatus 1 illustrated in FIGS. 1 and 2 is a color image forming apparatus with an intermediate transfer system using electrophotographic process technology. That is, image forming apparatus 1 transfers (primarily transfers) respective toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondarily transfers) the resultant image to sheet S, to thereby form an image.

A tandem system is adopted for image forming apparatus 1. In the tandem system, respective photoconductor drums 413 corresponding to the four colors of YMCK are placed in series in the running direction of intermediate transfer belt 421, and the toner images of the four colors are sequentially transferred to intermediate transfer belt 421 in one cycle.

As illustrated in FIGS. 1 and 2, image forming apparatus 1 includes image reading section 10, operation/display section 20, image processing section 30, image forming section 40, sheet conveying section 50, fixing section 60, and control section 100.

Control section 100 includes central processing unit (CPU) 101, read only memory (ROM) 102, and random access memory (RAM) 103, CPU 101 reads a program suited to processing contents out of ROM 102, develops the program in RAM 103, and integrally controls an operation of each block of image forming apparatus 1 in cooperation with the developed program. At this time, CPU 101 refers to various pieces of data stored in storage section 72. Storage section 72 is configured by, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet on the basis of the image data (input image data). Communication section 71 is configured by, for example, a communication control card such as a LAN card.

Image reading section 10 includes auto document feeder (ADF) 11, document image scanner 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of leading results provided by document image scanner 12. Image processing section 30 performs predetermined image processing on the input image data.

Operation/display section 20 includes, for example, a liquid crystal display (LCD) with a touch panel, and functions as display section. 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and secondary transfer unit 43 and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, and drum cleaning device 415.

Photoconductor drum 413 is, for example, a negatively-charged-type organic photoconductor (OPC) formed by sequentially laminating an wider coat layer (UCL), a charge generation layer (CCL), and a charge transport layer (CTL)

on the circumferential surface of a conductive cylindrical body (elementary tube) that is made of aluminum and has a drum diameter of 80 mm.

The charge generation layer is made of an organic semiconductor in which a charge generation material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Photoconductor drum 413 is connected to a driving motor (not illustrated) via a power transmission mechanism (not illustrated). Control section 100 controls a driving current of a driving motor, whereby photoconductor drum 413 is rotated at a constant circumferential speed.

Charging device 414 evenly negatively charges the surface of photoconductor drum 413.

Exposure device 411 is configured by, for example, a semiconductor laser, and irradiates photoconductor drum 413 with laser light corresponding to the image of each color component. Because the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 is of a two-component development system. Developing device 412 attaches the toner of each color component to the surface of photoconductor drum 413, and thus visualizes the electrostatic latent image to form a toner image. A specific configuration of developing device 412 will be described later.

Drum cleaning device 415 includes a drum cleaning blade that is brought into sliding contact with the surface of photoconductor drum 413, and removes residual toner that remains on the surface of photoconductor drum 413 after primary transfer.

Intermediate transfer unit 42 includes intermediate transfer belt 421 that functions as an intermediate transfer member, a plurality of support rollers 423 including backup roller 423A, and belt cleaning device 426.

Intermediate transfer belt 421 is configured by an endless belt, and is stretched on the plurality of support rollers 423 in a loop-like manner. At least one of the plurality of support rollers 423 is configured by a driving roller, and the others are each configured by a driven roller. Support roller 423 that functions as the driving roller rotates, whereby intermediate transfer belt 421 runs at a constant speed in the arrow A direction. Intermediate transfer belt 421 is brought into pressurized contact with photoconductor drums 413 by primary transfer rollers 422, whereby the toner images of the four colors are primarily transferred to intermediate transfer belt 421 so as to be sequentially superimposed on each other.

Secondary transfer unit 43 is configured in such a manner that secondary transfer belt 432 is looped around a plurality of support rollers 431 including secondary transfer roller 431A.

Secondary transfer roller 431A is brought into pressurized contact with backup roller 423A across intermediate transfer belt 421 and secondary transfer belt 432, whereby transfer nip is formed. When sheet S passes through transfer nip, the toner images carried on intermediate transfer belt 421 are secondarily transferred to sheet S. Specifically, a voltage (transfer bias) having a polarity opposite to that of the toner is applied to secondary transfer roller 431A, whereby the toner images are electrostatically transferred to sheet S. Sheet S to which the toner images have been transferred is conveyed to fixing section 60 by secondary transfer belt 432.

Belt cleaning device 426 includes a belt cleaning blade to be brought into sliding contact with the surface of intermediate transfer belt 421, and removes residual toner that remains on the surface of intermediate transfer belt 421 after secondary transfer.

Fixing section 60 heats and pressurizes sheet S conveyed thereto at its fixing nip, to thereby fix the toner images to sheet S. Fixing section 60 may include an air separation unit that blows air to thereby separate sheet S from a member on the fixing side (for example, a fixing belt) or a support member on the rear side (for example, a pressure roller).

Sheet conveying section 50 includes sheet feed section 51, sheet ejection section 52, and conveyance route section 53.

Three sheet feed tray units 51*a* to 51*c* included in sheet feed section 51 house sheets S (standard sheets, special sheets) discriminated on the basis of the basis weight, the size, and the like, for each type set in advance.

Conveyance route section 53 includes a plurality of paired conveyance rollers such as paired sheet stop rollers 53*a*. Sheets S housed in sheet feed tray units 51*a* to 51*c* are send out one by one from the topmost sheet, and are conveyed to image forming section 40 by conveyance route section 53. At this time, a sheet stop roller section including paired sheet stop rollers 53*a* corrects the skew of sheet S fed thereto, and adjusts conveyance timing thereof.

Then, image forming section 40 collectively secondarily transfers the toner images on intermediate transfer belt 421 to one side of sheet S, and fixing section 60 performs a fixing process thereon. Sheet S on which an image has been formed is ejected to the outside of the apparatus by sheet ejection section 52 including ejection rollers 52*a*.

Figure 3:
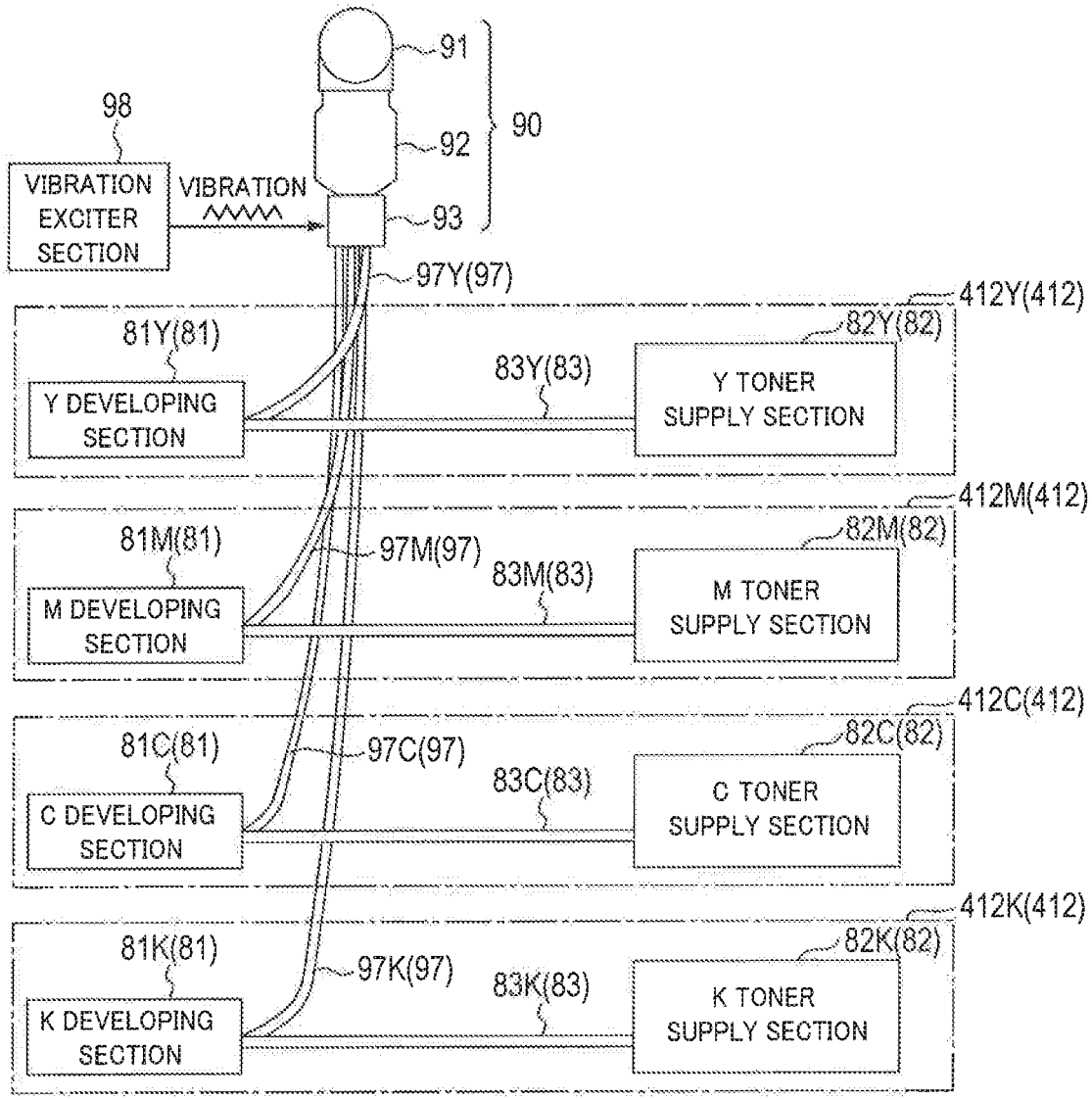
FIG. 3 illustrates a configuration of a developing device.

FIG. 3 illustrates configurations of developing devices 412Y, 412M, 412C, and 412K. As illustrated in FIG. 3, developing devices 412Y, 412M, 412C, and 412K include: developing sections 81Y, 81M, 81C, and 81K that form toner images of respective color components on respective photoconductor drums 413Y, 413M, 413C, and 413K; toner supply sections 82Y, 82M, 82C, and 82K that supply toners of respective color components to respective developing sections 81Y, 81M, 81C, and 81K; and carrier supply section 90 that supplies carrier to respective developing sections 81Y, 81M, 81C, and 81K, and the like. In other words, developing device 412 is configured so as to separately supply toner and carrier to developing section 81.

Toner supply sections 82Y, 82M, 82C, and 82K are provided for respective developing devices 412Y, 412M, 412C, and 412K, and are connected to respective developing sections 81Y, 81M, 81C, and 81K via respective toner flow channels 83Y, 83M, 83C, and 83K. For each toner supply section 82, a known technique can be employed.

Carrier supply section 90 includes: carrier housing section 92 that houses carrier and sends out a predetermined amount of carrier; carrier bottle 91 detachably attached to carrier housing section 92; carrier guiding section 93 that supplies carrier sent from carrier housing section 92 to respective developing sections 81Y, 81M, 81C, and 81K; and vibration section 98 that vibrates carrier guiding section 93 (more specifically, later-described carrier distributing member 95), and the like.

Only one carrier supply section 90 is provided for developing devices 412Y, 412M, 4120, and 412K. Since carrier is supplied utilizing free-fail motion of carrier under its own weight, carrier supply section 90 is arranged directly above all of developing sections 81Y, 81M 81C, and 81K.

Carrier supply section 90 supplies a predetermined amount of carrier to developing sections 81Y, 81M, 81C, and 81K via respective carrier flow channels 97Y, 97M, 97C, and 97K connected to carrier guiding section 93.

Vibration section 98 may be a vibration exciter that externally vibrates carrier guiding section 93. Alternatively, vibration may be generated by means of the inner structure of carrier guiding section 93. In the present embodiment, carrier guiding section 93 is configured to vibrate by means of an inner structure of carrier guiding section 93.

Figure 4:
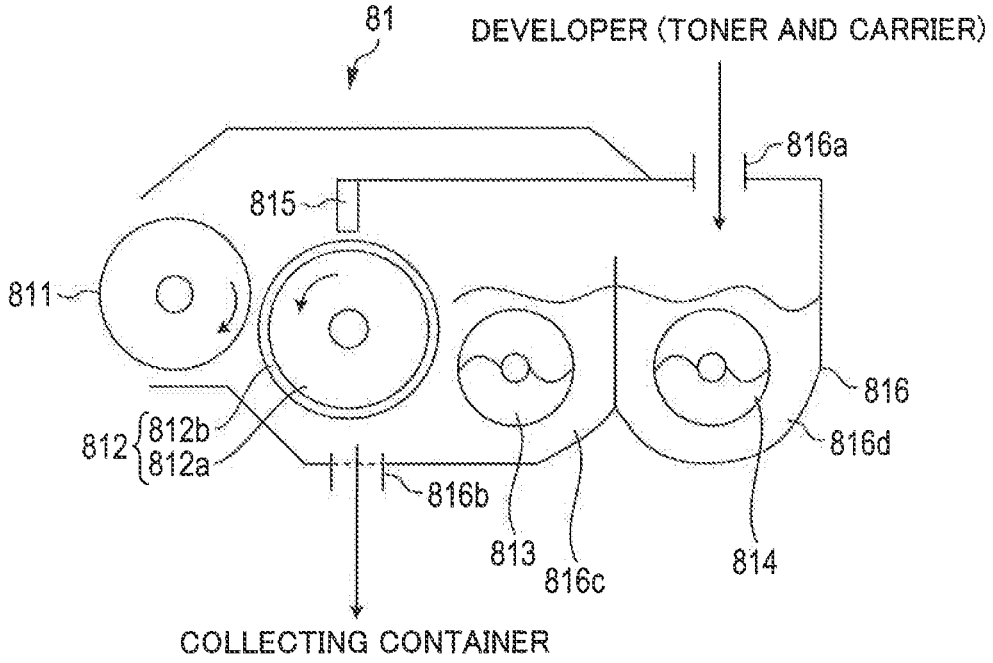
FIG. 4 illustrates an example configuration of a developing section.

FIG. 4 illustrates an example configuration of developing section 81. As illustrated in FIG. 4, developing section 81 includes developing roller 811 (toner carrier), conveyance roller 812 (developer carrier), stirring members 813 and 814, developer restriction member 815, and developing container 816, and the like. In other words, developing section 81 employs what is called a hybrid development system that is a combination of a two-component development system and a one-component development system to form a toner image on photoconductor drum 413.

The configuration of developing section 81 illustrated in FIG. 4 is an example, and any configuration that uses a two-component developer, that is, employs a two-component development system (including a hybrid development system) to form a toner image on photoconductor drum 413 can be employed with no specific limitation.

In developing container 816, stirring member 814, stirring member 813, conveyance roller 812 and developing roller 811 are arranged in this order from the upstream side to the downstream side in a developer conveyance direction (from the right side to the left side in FIG. 4).

Developing container 816 includes developer resupply port 816*a* (substantially directly above stirring member 814 in FIG. 4) for developer resupply. Toner that has flown down in toner flow channel 83 and carrier that has flown down in carrier flow channel 97 are mixed and resupplied to developing container 816 via developer resupply port 816*a*.

Developing container 816 also includes developer discharging port Slob for developer discharge (substantially directly below conveyance roller 812 in FIG. 4). Developer in developing container 816 is periodically discharged via developer discharging port 816*h* and recovered into a developer collection container (not illustrated).

Stirring members 813 and 814 each include a stirring screw extending in an axial direction, and stir developer while circulating and conveying the developer between stirring chambers 816*c* and 816*d*. Consequently, toner and carrier contained in the developer frictionally contact each other and thereby are charged so as to have polarities opposite to each other. Here, the carrier is deemed positively charged and the toner is deemed negatively charged.

The negatively-charged toner adheres to the periphery of the positively-charged carrier mainly by means of an electric attraction force between the toner and the carrier. The developer is supplied to conveyance roller 812 over the course of the developer being conveyed by stirring member 813.

Conveyance roller 812 is what is called a magnet roller including unrotatably fixed magnet body 812*a*, and a cylindrical conveyance sleeve 812*b* rotatably arranged on the periphery of magnet body 812*a*.

Substantially directly above conveyance sleeve 612*b*, developer restriction member 815 is disposed at a predetermined distance from conveyance sleeve 812*b* so as to face conveyance sleeve 812*b*, Developer restriction member 815 is a plate-like member including a magnetic substance such as stainless steel, and extends in parallel to conveyance roller 812.

Magnet body 812*a* includes a plurality of magnetic poles (not illustrated) extending in an axial direction of conveyance roller 812. The plurality of magnetic poles form a magnetic field (magnetic lines of force) for conveying the developer by means of conveyance sleeve 812*b*.

Particles of the developer supplied to conveyance sleeve 812*h* erect in chain rows along the magnetic lines of force formed by magnet body 812*a*, forming what is called a magnetic brush. The developer is conveyed counterclockwise along with rotation of conveyance sleeve 812*b*, and is restricted to a certain thickness as a result of passing through a gap between developer restriction member 815 and conveyance sleeve 812*b*.

Developing roller 811 is a conductive roller including a metal such as aluminum. Developing roller 811 may be one configured by forming a coating of, e.g., a polyester resin on an outer peripheral surface of a conductive roller.

As a result of a magnetic field being formed between developing roller 811 and conveyance roller 812., only the toner is detached from the developer conveyed by conveyance sleeve 812*b* and supplied to developing roller 811. Developing roller 811 supplies the toner to photoconductor drum 413 to visualize an electrostatic latent image on photoconductor drum 413.

Also, developing section 81 employs a trickle development system in which a developer is gradually replaced. In other words, developing section 81 is configured so that a developer is periodically resupplied from developer resupply port 816*a* while extra developer is discharged from developer discharging port 816*b* (trickle mechanism). For the trickle mechanism, one of a known circulation overflow type or liquid face overflow type can be employed.

Consequently, degraded carrier is replaced with new carrier, whereby toner in developing container 816 is consistently evenly charged. Accordingly, stable image quality can be provided irrespective of the number of sheets subjected to printing and/or environmental changes.

Figure 5:
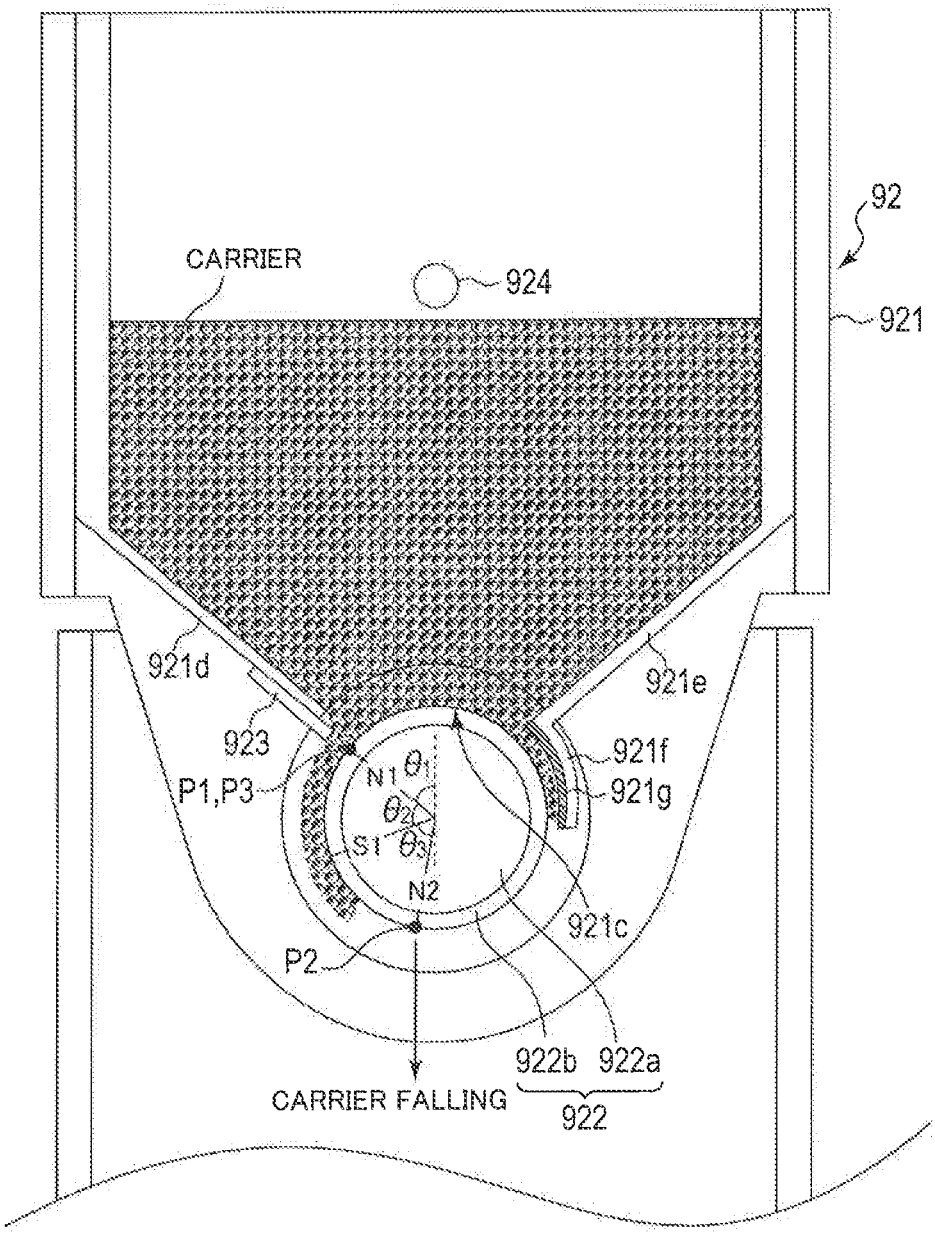
FIG. 5 illustrates an example configuration of a carrier housing section.

FIG. 5 illustrates an example configuration of carrier housing section 92. As illustrated in FIG. 5, carrier housing section 92 includes carrier container 921 (carrier hopper), measuring roller 922, carrier restriction member 923, and remaining amount detection sensor 924, and the like.

Here, the configuration of carrier housing section 92 illustrated iii FIG. 5 is an example, and the configuration of carrier housing section 92 is not specifically limited as long as the configuration enables a predetermined amount of carrier to be measured out with good accuracy and makes the measured carrier fall in carrier guiding section 93.

Carrier container 921 has a substantially cuboidal shape extending in an axial direction of measuring roller 922. At a lower portion of carrier container 921, substantially-rectangular carrier supply port 921*c* extending in the axial direction of measuring roller 922 is formed. Below carrier supply port 921*c*, measuring roller 922 is arranged.

Sidewall 921*d* extending obliquely upward from one long side of carrier supply port 921*c* is formed so that an end portion thereof is positioned at a predetermined distance from a peripheral surface of measuring roller 922. Carrier restriction member 923, which serves as a layer thickness restriction member, is attached to sidewall 921*d*.

Carrier restriction member 923 is arranged obliquely above measuring roller 922 at a predetermined distance from measuring sleeve 922*b* so as to face measuring roller 922. The distance between carrier restriction member 923 and measuring roller 922 is set to, for example, 0.1 to 1.0 mm. Carrier restriction member 923 is a plate-like member made of a magnetic substance such as stainless steel material, and extends in parallel to measuring roller 922.

Furthermore, sidewall 921*e* extending obliquely upward from the other long side of carrier supply port 921*c* is formed so that an end portion thereof is positioned close to measuring roller 922. At the end portion of sidewall 921*e*, rib 921*f* is provided along a surface of pleasuring roller 922 so as to be continuous with the end portion. On an inner surface of rib 921*f* a tape-like magnetic strip 921*g* on which N poles and S poles are alternately formed in a width direction is put along the axial direction of measuring roller 922. Rib 921*f* (magnetic strip 921*g*) and measuring roller 922 are not in contact with each other, and a distance therebetween is set to, for example, 0.1 to 1.5 mm. Since carrier is bound by a magnetic field formed by magnetic strip 921*g*, the carrier is held without free fall.

Carrier bottle 91(see FIG. 3) is connected to an upper portion of carrier container 921, and if remaining amount detection sensor 924 detects that the amount of carrier in carrier container 921 becomes equal to or lower than a predetermined amount, a fixed amount of carrier is automatically resupplied from carrier bottle 91. For example, control section 100 performs control to open/close a shutter member (not illustrated) provided openably/closably at a supply port of carrier bottle 91, based on a detection signal from remaining amount detection sensor 924, whereby a fixed amount of carrier is automatically resupplied from carrier bottle 91. Consequently, it is possible to prevent the problem of shortage of carrier in carrier container 921 that results in failure to supply a fixed amount of carrier to developing section 81.

Measuring roller 922 is what is called a magnet roller including unrotatably-fixed magnet body 922*a* and cylindrical measuring sleeve 922*b* rotatably arranged on the periphery of magnet body 922*a*.

Magnet body 922*a* includes a plurality of magnetic poles N1, S1, and N2 extending in the axial direction of measuring roller 922.

Magnetic pole N1 is arranged at a position corresponding to layer thickness restriction position P3 where the thickness of the carrier layer is restricted by carrier restriction member 923. Here, carrier adheres to measuring sleeve 922*b* at layer thickness restriction position P3, and thus, layer thickness restriction position P3 and carrier adhering position P1 are the same, Magnetic pole N2 is arranged at a position corresponding to carrier detaching position P2 where carrier is detached and falls, Magnetic pole S1 is arranged midway between magnetic pole N1 and magnetic pole N2.

Here, angle $\theta_1$ formed by magnetic pole N1 and a vertical line is preferably set to $45° \leq 55°$; angle $\theta_2$ formed by magnetic pole N1 and magnetic pole S1 is preferably set to $50° \leq \theta_2 \leq 70°$; and angle $\theta_3$ formed by magnetic pole S1 and magnetic pole N2 is preferably set to $50° \leq \theta_3 \leq 80°$.

Consequently, carrier conveying capability, and carrier removability at detaching position. P2 can be ensured.

As a result of the arrangement of magnetic poles N1, S1, and N2 as described above, magnetic fields such as described below are formed in the vicinity of measuring sleeve 922*b*. An end portion on the measuring roller 922 side of carrier restriction member 923 is magnetized by magnetic pole N1 to have a pole (S pole) opposite to magnetic pole N1. Also, at layer thickness restriction position P3, a magnetic field (magnetic lines of force) extending from magnetic pole N1 toward carrier restriction member 923 is formed.

Magnetic fields that bind carrier to measuring sleeve 922*h* is formed from adhering position P1 to detaching position P2, by magnetic pole and magnetic pole S1, and magnetic pole S1 and magnetic pole N2.

Also, a repelling magnetic field (magnetic field that pulls carrier away from measuring sleeve 922*b*) is formed downstream of detaching position P2 in a carrier conveyance direction, by magnetic pole N2 and magnetic pole N1.

Carrier housed in carrier container 921 is attracted by magnetic pole N1 at adhering position P1 and adheres to measuring sleeve 922*b*. Here, erected carrier chain rows run in a direction normal to measuring sleeve 922*b* along the magnetic field formed by magnetic pole N1 and carrier restriction member 923.

The erected carrier chain rows pass through layer thickness restriction position P3 along with rotation (counterclockwise rotation) of measuring sleeve 922*b* with such a carrier state kept. The carrier chain rows are trimmed by a gap between carrier restriction member 923 and measuring sleeve 922*b* to form a carrier layer with a fixed thickness on measuring sleeve 922*b*.

The layer of carrier with restricted thickness is bound onto measuring sleeve 922*h* along the magnetic field formed by magnetic pole N1 and magnetic pole S1, and the magnetic field formed by magnetic pole S1 and magnetic pole N2, and is conveyed from adhering position P1 to detaching position P2 along with rotation of measuring sleeve 922*b*.

The carrier conveyed to detaching position P2 is detached from measuring sleeve 922*b* under its own weight. Since the repelling magnetic field is formed between magnetic pole N2 and magnetic pole N1 at detaching position P2, the carrier that has reached detaching position P2 is easily detached from measuring sleeve 922*h* without being bound onto measuring sleeve 922*b* and falls.

Then, the carrier falls in carrier guiding section 93 connected to a lower portion of carrier housing section 92, and is guided to developing to section 81, which is a supply destination, via carrier flow channel 97 (see FIG. 3).

Figure 6:
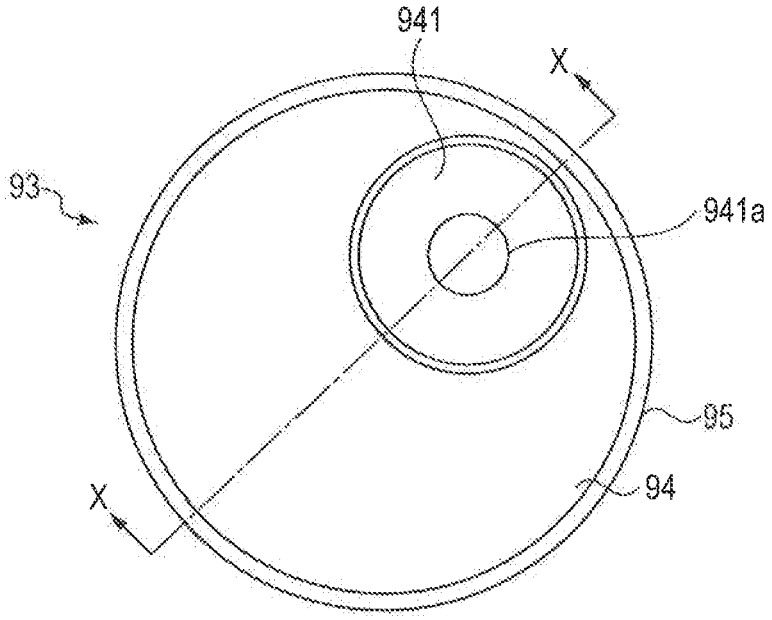
FIG. 6 is a top view of a carrier guiding section.
Figure 7:
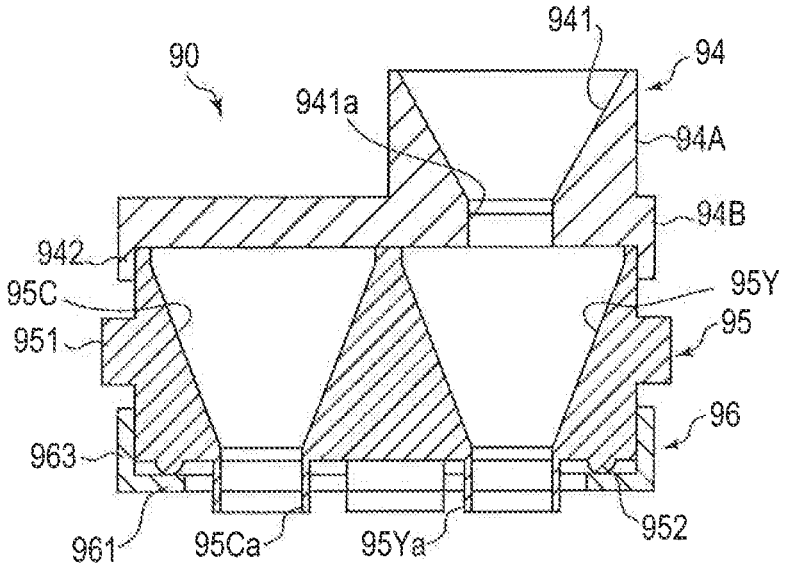
FIG. 7 is a cross-sectional view taken along arrow X-X in FIG. 6.

FIG. 6 is a top view of carrier guiding section 93. FIG. 7 is a cross-sectional view taken along arrow X-X of FIG. 6.

As illustrated in FIGS. 6 and 7, carrier guiding section 93 includes carrier receiving member 94 that receives carrier falling from carrier housing section 92, carrier distributing member 95 to be connected to a lower portion of carrier receiving member 94, and support frame body 96 that supports carrier distributing member 95 in such a manner that carrier distributing member 95 can slide while rotating, and the like. Each of carrier receiving member 94, carrier distributing member 95, and support frame body 96 is a molded body made of, for example, a resin material.

Although in the present embodiment, carrier is distributed to the plurality of developing sections 81Y, 81M, 81C, and 81K by making carrier distributing member 95 slide while rotating, a configuration allowing carrier to be distributed by means of linear sliding of carrier distributing member 95 relative to support frame body 96 may be employed.

Carrier receiving member 94 is a double-deck cylindrical member including upper cylindrical portion 94A and lower cylindrical portion 94B. At one of areas resulting from quartering lower cylindrical portion 94B in a planar view, upper cylindrical portion 94A is formed. Funnel-like upper carrier receiving section 941 (hereinafter, upper receiving section 941) whose diameter decreases downward from an upper surface thereof is formed from upper cylindrical portion 94A to lower cylindrical portion 94B. Also, carrier supply port 941*a* is provided so as to be continuous with a lower portion of upper receiving section 941. A taper angle of upper receiving section 941 is set to an angle allowing carrier particles to roll (a repose angle or larger (for example, 20° or larger)). Carrier that has fallen in upper receiving section 941 falls in carrier distributing member 95 via carrier supply port 941*a*.

Also, at a lower peripheral edge of lower cylindrical portion 94B, peripheral wall 942 is formed, and an upper portion of carrier distributing member 95 is loosely fitted on the inside of peripheral wall 942.

Figure 8:
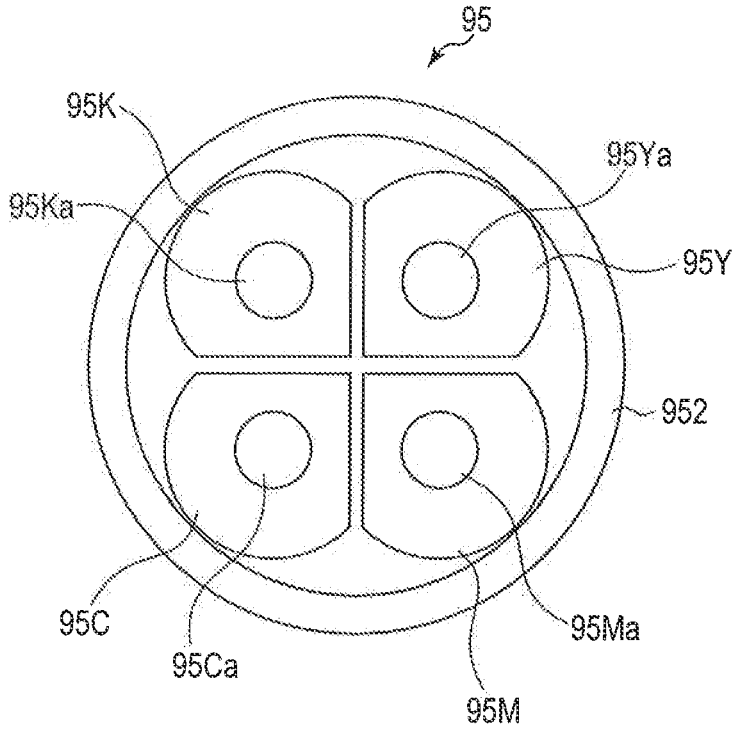
FIG. 8 is a top view of a carrier distributing section.
Figure 9:
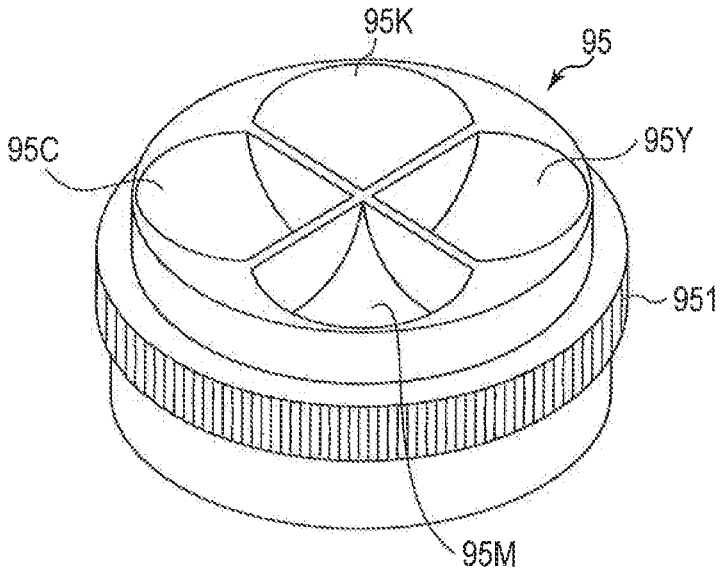
FIG. 9 is a top perspective view of a carrier distributing section.
Figure 10:
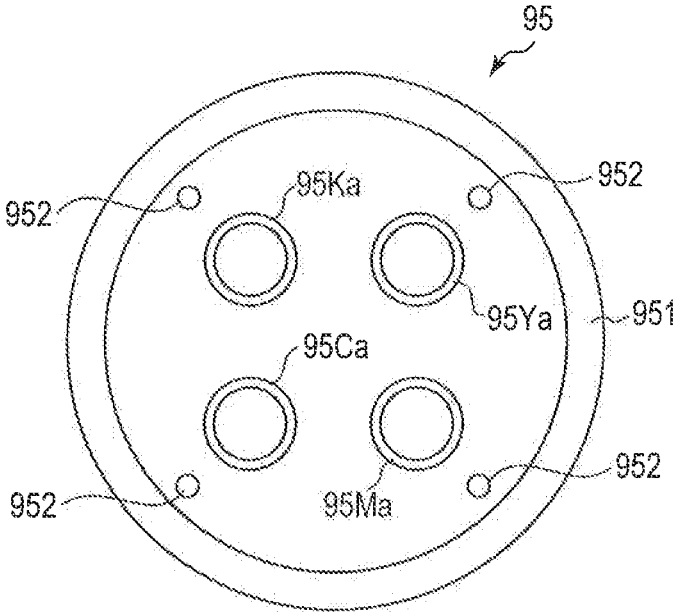
FIG. 10 is a bottom view of a carrier distributing section.
Figure 11:
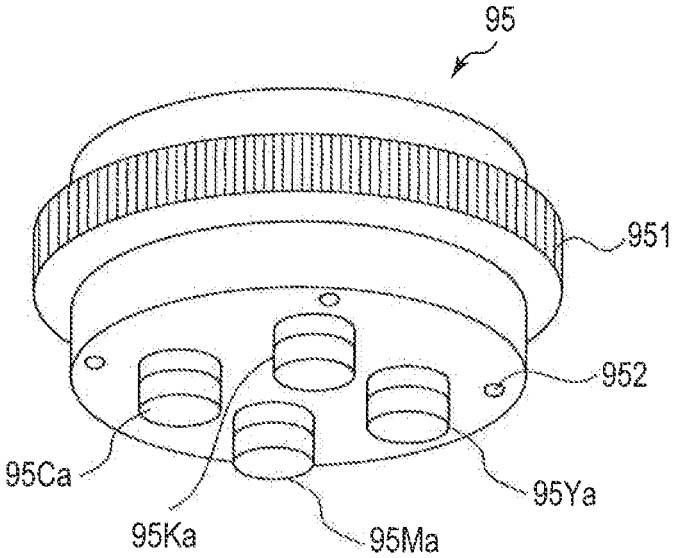
FIG. 11 is a bottom perspective view of a carrier distributing section.

A specific configuration of carrier distributing member 95 is illustrated in FIGS. 8 to 11. FIG. 8 is a top view of carrier distributing member 95. FIG. 9 is a top perspective view of carrier distributing member 95. FIG. 10 is a bottom view of carrier distributing member 95, FIG. 11 is a bottom perspective view of carrier distributing member 95.

As illustrated in FIGS. 7 to 11, carrier distributing member 95 is a substantially-cylindrical member. In respective areas resulting from quartering carrier distributing member 95 in a planar view, funnel-like lower carrier receiving sections 95Y, 95M, 95C, and 95K (hereinafter, lower receiving sections 95Y, 95M, 95C, and 95K) whose diameters decrease downward from respective upper surfaces are formed on the same circle, Also, carrier supply ports 95Ya, 95Ma, 95Ca, and 95Ka are provided so as to be continuous with respective lower receiving sections 95Y, 95M, 95C, and 95K. As with upper receiving section 941, a taper angle of each of lower receiving sections 95Y, 95M, 95C, and 95K is set to an angle allowing carrier particles to roll (a repose angle or larger (for example, 20° or larger)).

At a peripheral surface at a substantial center in a vertical direction of carrier distributing member 95, gear portion 951 to be connected to a gear transmission mechanism (not illustrated) is formed. The gear transmission mechanism (not illustrated) is connected to a motor (not illustrated). Upon the motor (not illustrated) being driven, carrier distributing member 95 is rotated via the gear transmission mechanism (not illustrated) and gear portion 951. The driving of the motor (not illustrated) is controlled by control section 100.

Respective one ends of carrier flow channels 97Y, 97M, 97C, and 97K are connected to respective carrier supply ports 95Ya, 95Ma, 95Ca, and 95Ka (see FIG. 3).

Carrier flow channels 97Y, 97M, 97C, and 97K are each forced of a flexible time having elasticity. An angle of attachment of each of carrier flow channels 97Y 97M, 97C, and 97K is set to an angle allowing carrier particles to roll (a repose angle or larger (for example, 20 or larger)). Respective other ends of carrier flow channels 97Y, 97M, 97C, and 97K are connected to respective resupply ports (not illustrated) formed at a position partway through toner flow channel 83.

At a lower surface of carrier distributing member 95, four support leg portions 952 each having, for example, a semi-spherical shape are formed so as to project downward on the outer side in a radial direction of respective carrier supply ports 95Ya, 95Ma, 95Ca, and 95Ka.

Figure 12:
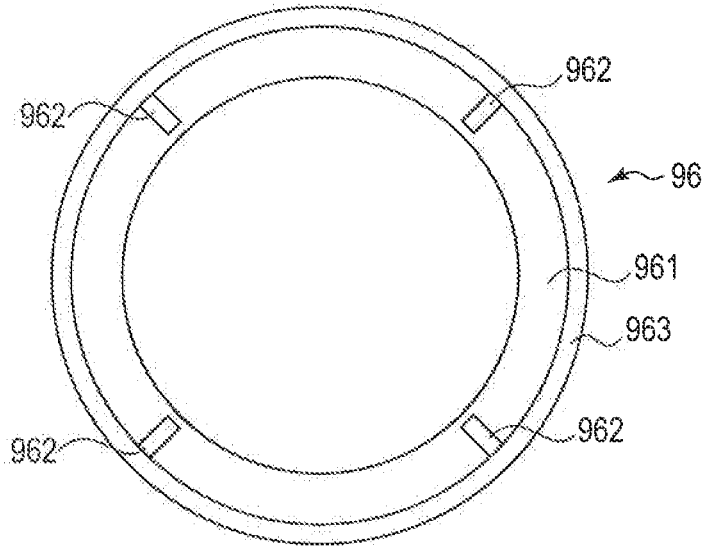
FIG. 12 is a top view of a support frame body.
Figure 13:
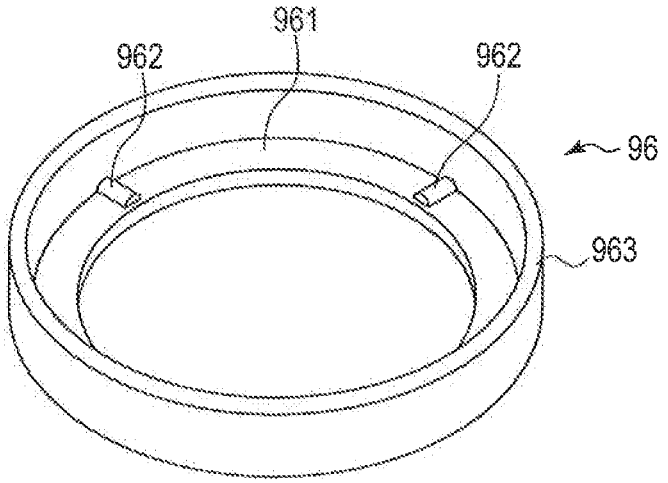
FIG. 13 is a top perspective view of a support frame body.

A specific configuration of support frame body 96 is illustrated in FIGS. 12 and 13. FIG. 12 is a top view of support frame body 96. FIG. 13 is a top perspective view of support frame body 96.

As illustrated in FIGS. 12 and 13, support frame body 96 is a substantially-cylindrical member. At a bottom portion of support frame body 96, mount portion 961 allowing carrier distributing member 95 to be mounted thereon is formed in an annular shape. A lower portion of carrier distributing member 95 is loosely fitted on the inside of peripheral wall 963 of support frame body 96. In other words, carrier distributing member 95 is vertically sandwiched between carrier receiving member 94 and support frame body 96 in a rotatable manner.

At each of positions resulting from quartering mount portion 961, step portion 962 having, for example, a semicircular column shape is horizontally provided. A height of step portions 962 is set to be lower than a height of support leg portions 952 so that when carrier distributing member 95 rotates, support leg portions 952 come into sliding contact with mount portions 961.

Here, there is no specific limitations on the shape, size, positions and count of support leg portions 952 and step portions 962 as long as along with rotation of carrier distributing member support leg portions 952 climb over step portions 962, generating vibration of carrier distributing member 95.

However, in order to evenly generate vibration of carrier distributing member 95, it is preferable that each of support leg portions 952 and step portions 962 be formed so as to be symmetrical with respective to the center.

Also, it is preferable that when any of lower receiving sections 95Y, 95M, 95C, and 95K of carrier distributing member 95 is located at a carrier falling position (position corresponding to carrier supply port 941*a* of carrier receiving member 94), step portions 962 do not climb on support leg portions 952. In other words, it is preferable that each step portion 962 be located at a position corresponding to a midpoint between two adjacent support leg portions 952 and 952. Consequently, lower receiving sections 95Y, 95M, 95C, and 95K can receive falling carrier in a stable state.

Furthermore, setting the height of step portions 962 to be high enables large vibration of carrier distributing member 95 to be generated. Furthermore, it is preferable that at least either support leg portions 952 or step portions 962 have a spherical shape in order to prevent rotation of carrier distributing member 95 from being hindered.

At the time of carrier resupply, carrier distributing member 95 is rotated so that lower receiving sections 95Y, 95M, 95C, and 95K are sequentially moved to the carrier failing position.

Carrier particles that have fallen in lower receiving sections 95Y, 95M, 95C, and 95K are sent out to respective carrier flow channels 97Y, 97M, 97C, and 97K via respective carrier supply ports 95Ya, 9514*a*, 95Ca, and 95Ka. The carriers flow down in respective carrier flow channels 97Y, 97M, 97C, and 97K and are supplied to respective developing sections 81Y, 81M, 81C, and 81K together with toners that have flown down in respective toner flow channels 83Y, 83M, 83C, and 83K (see FIG. 3).

Figure 14:
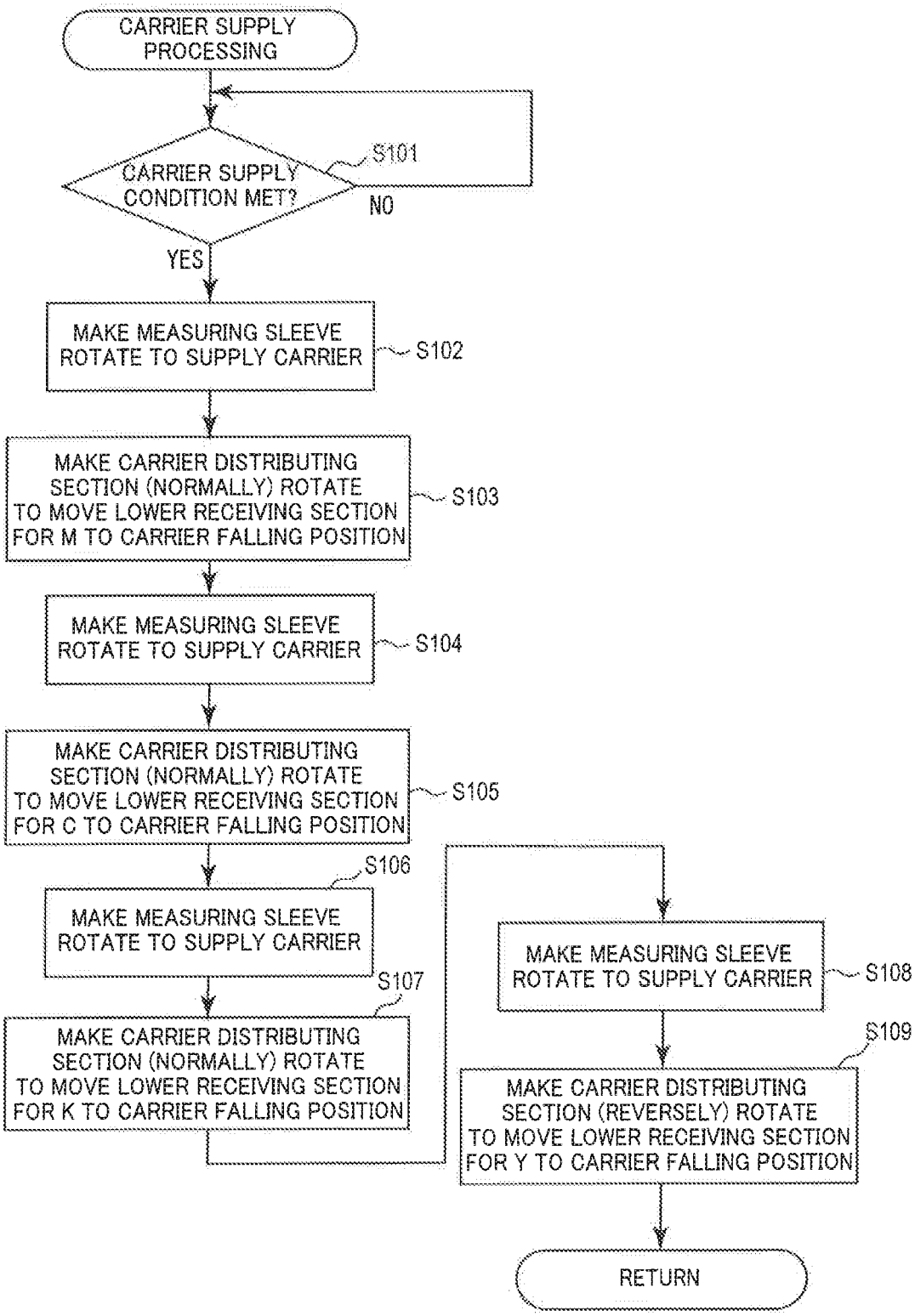
FIG. 14 is a flowchart illustrating an example of carrier supply processing.

More specifically, carrier is supplied according to the flowchart illustrated in FIG. 14.

FIG. 14 is a flowchart illustrating an example of carrier supply processing. The carrier supply processing illustrated in FIG. 14 is implemented by, for example, CPU 101 executing a predetermined program stored in ROM 102 upon start of an image forming operation in image forming apparatus 1. The respective blocks of carrier supply section 90 are controlled by the carrier supply processing.

Figure 15:
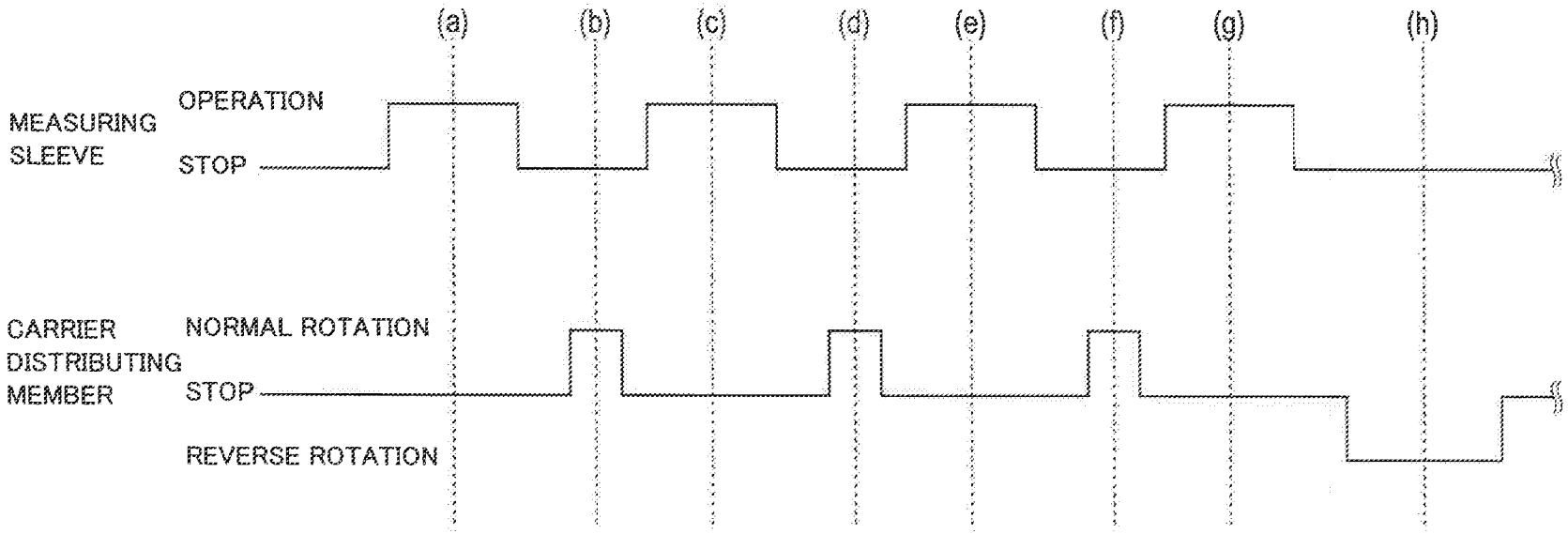
FIG. 15 is a timing chart illustrating an operation of a measuring roller in a carrier housing section.
Figure 16A:
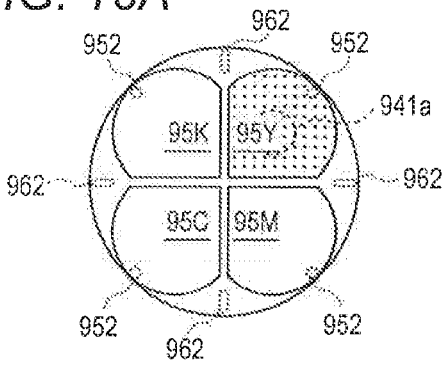
FIGS. 16A to 16H illustrate state transitions when a carrier distributing section rotates.

FIG. 15 illustrates an operation of measuring roller 922 in carrier housing section 92, and FIGS. 16A to 1614 illustrate states of carrier distributing member 95 in (a) to (h) of FIG. 15.

It is assumed that in an initial state, lower receiving section 95Y for Y in carrier distributing member 95 is located at the carrier failing position and each step portion 962 of support frame body 96 is located at a midpoint between adjacent support leg portions 952 and 952 of carrier distributing member 95 (see FIG. 16A).

In step S101 in FIG. 14, control section 100 determines whether or not a carrier supply condition is met. Then, control section 100 waits until the carrier supply condition is met, and if control section 100 determines that the carrier supply condition is met, the processing proceeds to step S102.

The carrier supply condition is a preset index for determining whether or not a developer in developing section 81 has been degraded, and for example, the number of sheets subjected to printing on which images have been formed (for example, 1000 sheets) or the like. The carrier supply condition is arbitrarily set according to the development conditions and/or the environmental conditions.

In step S102, control section 100 makes measuring sleeve 922*h* rotate to make a predetermined amount of carrier fall in lower receiving section 95Y for Y (for example, for 5 seconds; see (a) in FIG. 15 and in FIG. 16A). An amount of carrier to be supplied from carrier supply section 90 to developing section 81 is controlled according to an amount of carrier that has reached detaching position P2, that is, distance G between carrier restriction member 923 and measuring sleeve 922*b*, and an amount of rotation of measuring sleeve 922*b*. Since the distance between carrier restriction member 923 and measuring sleeve 922*b* is constant, controlling the amount of rotation of measuring sleeve 922*b* with high accuracy enables a fixed amount of carrier to fall with good accuracy and be supplied to developing section 81.

Particles of the fallen carrier roll inside carrier flow channel 97Y via lower receiving section 95Y, and are supplied to developing section 81Y together with toner. At this time, a part of the carrier (for example, around 1/10 of the supplied amount) adheres to a surface of lower receiving section 95Y.

Figure 16E:
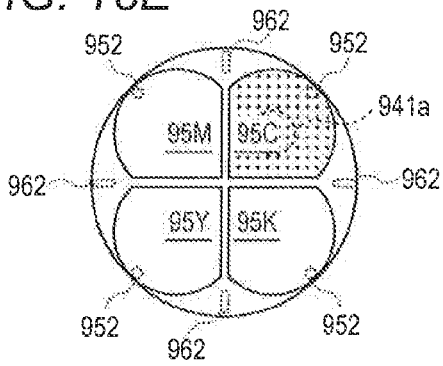
Figure 16B:
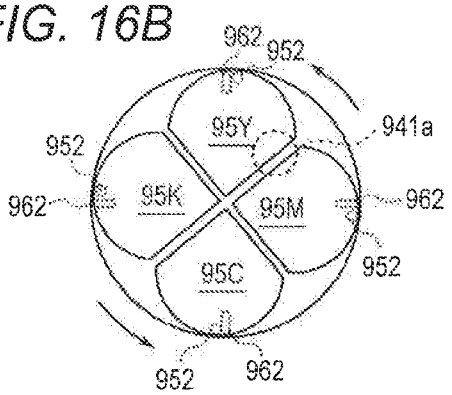

In step S103, control section 100 makes carrier distributing member 95 rotate (for, for example, two seconds: see (b) in FIG. 15 and FIG. 16B). It is assumed that a direction of the rotation of this case (counterclockwise rotation in FIG. 16B) is forward rotation. Consequently, lower receiving section 95M for M is moved to the carrier falling position.

Figure 17A:
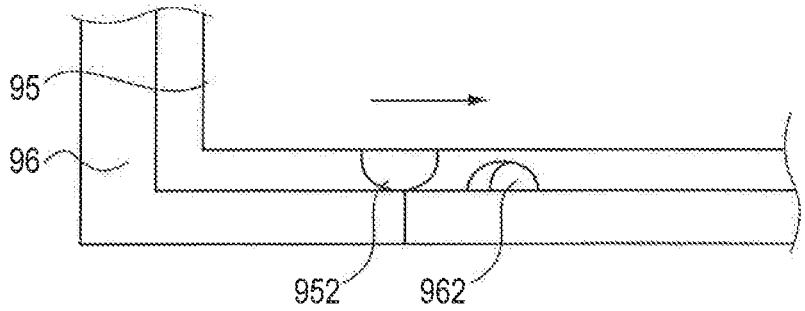
FIGS. 17A, 17B and 17C illustrate a manner in which a support leg portion climbs over a step portion.
Figure 17B:
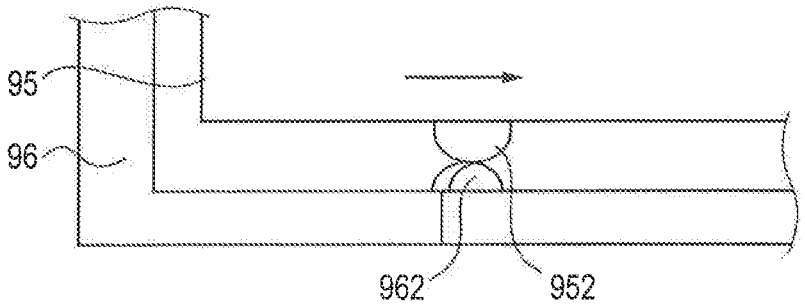
Figure 17C:
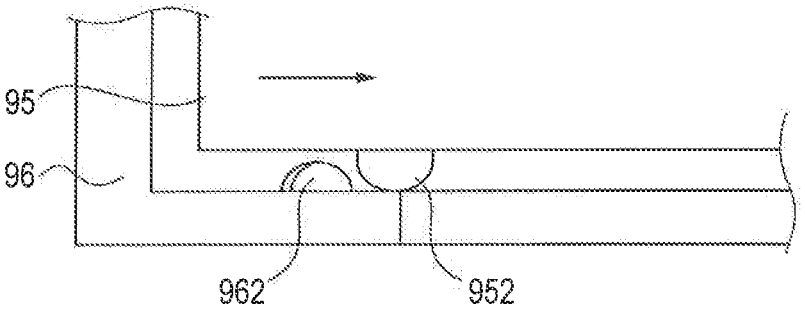

Then, as illustrated in FIGS. 17A to 17C, carrier distributing member 95 slides while rotating with support leg portions 952 in contact with mount portion 961 of support frame body 96. Then, over the course of rotation of carrier distributing member 95, support leg portions 952 climb over respective step portions 962 positioned downstream in the rotation direction. In other words, carrier distributing member 95 vertically moves in a short period of time, whereby carrier distributing member 95 vibrates. Accordingly, particles of the carrier adhering to lower receiving section 95Y for Y are shaken off by the vibration, and roll in carrier flow channel 97Y and are supplied to developing section 81Y together with toner. As a result, a desired amount of carrier is supplied to developing section 81Y.

Likewise, as with supply of carrier to developing section 81Y, carrier is supplied to each of developing sections 81M, 81C, and 81K. In other words, in step S104, control section 100 makes measuring sleeve 922*b* rotate to make the predetermined amount of carrier fall in lower receiving section 95M for M (for, for example, five seconds: see (c) in FIG. 15 and in FIG. 16C). Particles of the fallen carrier roll inside carrier flow channel 97M via lower receiving section 95M and are supplied to developing section 81M together with toner.

Figure 16F:
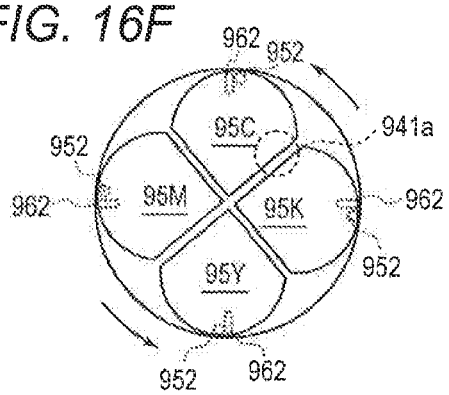
Figure 16C:
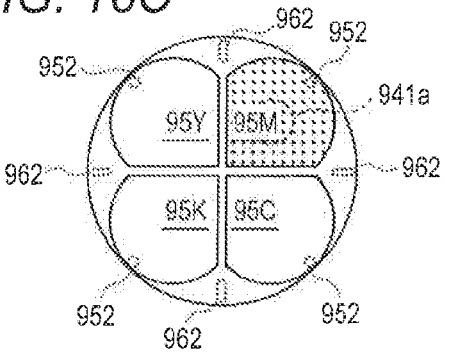
Figure 16G:
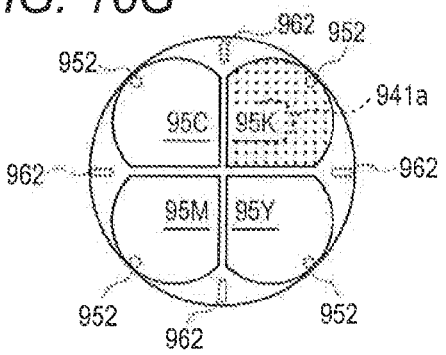
Figure 16D:
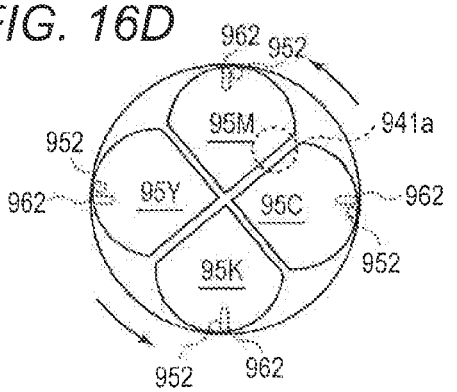

In step S105, control section 100 makes carrier distributing member 95 forwardly rotate to move lower receiving section 95C for C to the carrier falling position (for, for example, two seconds: see (d) in FIG. 15 and in FIG. 16D).

Even if a part of the carrier (for example, around 1/10 of the supplied amount) adheres to a surface of lower receiving section 95M, the carrier is shaken off by vibration generated along with rotation of carrier distributing member 95, and thus, the desired amount of carrier is supplied to developing section 81M.

In step S 106, control section 100 makes measuring sleeve 922*b* rotate to make the predetermined amount of carrier fall in lower receiving section 95C for C (for, for example, five seconds: see (e) in FIG. 15 and in FIG. 16E). Particles of the fallen carrier roll inside carrier flow channel 97C via lower receiving section 95C and are supplied to developing section 81C together with toner.

In step S107, control section 100 makes carrier distributing member 95 forwardly rotate to move lower receiving section 95K for K to the carrier failing position (for, for example, two seconds: see (f) in FIG. 15 and in FIG. 16F).

Even if a part of the carrier (for example, around 1/10 of the supplied amount) adheres to a surface of lower receiving section 95C, the carrier is shaken off by vibration generated along with rotation of carrier distributing member 95, and thus, the desired amount of carrier is supplied to developing section 81C.

In step S108, control section 100 makes measuring sleeve 922*b* rotate to make the predetermined amount of carrier fall in lower receiving section 95K for K (for, for example, five seconds: see (g) in FIG. 15 and in FIG. 16G), Particles of the fallen carrier roll inside carrier flow channel 97K via lower receiving section 95K and are supplied to developing section 81K together with toner.

Figure 16H:
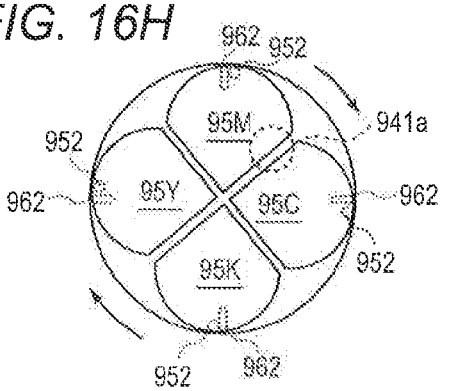

In step S109, control section 100 makes carrier distributing member 95 reversely rotate to move lower receiving section 95Y for Y to the carrier falling position to return to the initial state (for, for example, six seconds: see (h) in FIG. 15 and in FIG. 16H).

Even if a part of the carrier (for example, around 1/10 of the supplied amount) adheres to a surface of lower receiving section 95K, the carrier is shaken off by vibration generated along with rotation of carrier distributing member 95, and thus, the desired amount of carrier is supplied to developing section 81K.

Subsequently, each time the carrier supply condition is met, for example, each time image formation for 1000 sheets has been achieved, carrier supply is performed. In the manner as described above, carrier is supplied to each developing section 81.

In developing section 81, an excessive amount of developer including degraded carrier is discharged by the trickle mechanism along with supply of carrier and toner. Consequently, the degraded carrier is replaced with new carrier, and thus, toner can consistently be evenly charged, enabling provision of stable image quality irrespective of the number of sheets subjected to printing and/or environmental changes.

As illustrated in FIGS. 16A to 16H, after carrier supply to each lower receiving section 95Y, 95M, 95C, or 95K, support leg portions 952 climb over step portions 962 at least once. Accordingly, carrier adhering to each lower receiving section 95Y, 95M, 95C, or 95K is reliably shaken off by vibration.

Although it is possible that after carrier supply to all of lower receiving sections 95Y, 95M 95C, and 95K, support leg portions 952 climb over step portions 962 only once, it is preferable that as many vibrations as possible be generated in order to shake off carrier adhering to lower receiving sections 95Y, 95M, 95C, and 95K.

As described above, image forming apparatus 1 includes: a plurality of developing sections 81Y, 81M, 81C, and 81K that develop electrostatic latent images respectively formed on a plurality of photoconductor drums (photoconductors) 413Y, 413M, 4130, and 413K using a developer including a corresponding color toner and carrier to form a toner image; toner supply sections 82Y, 82M, 82C, and 82K that supply the corresponding color toner to the plurality of developing sections 81Y, 81M, 81C, and 81K, respectively; carrier supply section 90 provided separately from toner supply sections 82Y, 82M, 82C, 82C, and 82K, carrier supply section 90 supplying carrier to the plurality of developing sections 81Y, 81M, 81C, and 81K; and control section 100 that controls an operation of carrier supply section 90.

Also, carrier supply section 90 includes: carrier housing section 92 that houses the carrier; carrier distributing member 95 (carrier distributing section) that receives a predetermined amount of carrier that has freely fallen from carrier housing section 92 and guides the predetermined amount of carrier to each of the plurality of developing sections 81Y, 81M, 81C, and 81K; support frame body 96 (support frame section) that slidably supports carrier distributing member 95; and vibration section 98 that vibrates carrier distributing member 95.

According to image forming apparatus 1, vibration of carrier distributing member 95 is generated by vibration section 98, and thus, it is possible to prevent carrier that has freely fallen from carrier housing section 92 from adhering to and being deposited on carrier distributing member 95 (more specifically, lower receiving sections 95Y, 95M, 95C, and 95K). Accordingly, a fixed amount of carrier can be supplied from carrier supply section 90 to the plurality of developing sections 81Y, 81M 81C, and 81K with good accuracy, enabling maintenance of stable image quality.

Furthermore, the need for periodic replacement of developer by a service engineer is eliminated and thus apparatus down-time is reduced.

Also, in image forming apparatus 1, carrier distributing member 95 has a cylindrical shape, and includes the plurality of lower receiving sections 95Y, 95M, 95C, and 95K (carrier receiving sections) formed on the same circle at an upper face thereof and connected to the plurality of developing sections 81Y, 81M, 81C, and 81K, respectively.

At the time of carrier resupply, control section 100 makes the predetermined amount of carrier freely fail from carrier housing section 92, and makes carrier distributing member 95 (carrier distributing section) rotate on support frame body 96 (support frame section) so that the plurality of lower receiving sections 95Y, 95M, 95C, and 95K are sequentially moved to the carrier falling position.

Consequently, carrier can be distributed to the plurality of developing sections 81Y, 81M, 81C, and 81K with a relatively simple configuration.

Also, in image forming apparatus 1, on the lower surface of carrier distributing member 95 (carrier distributing section), support leg portions 952 that project downward are formed, and step portions 962 are formed on a surface of support frame body 96 (support frame section) that slides relative to carrier distributing member 95.

Along with rotation of carrier distributing member 95 during carrier resupply (from a start of forward rotation to reverse rotation to return to initial state), support leg portions 952 climb over step portions 962, whereby vibrations of carrier distributing member 95 are generated. In other words, support leg portions 952 and step portions 962 provide vibration section 98.

Consequently, there is no need to provide a vibration generating apparatus that vibrates carrier distributing member 95, and thus, carrier can be distributed to the plurality of developing sections 81Y, 81M, 81C, and 81K with a relatively simple configuration, and there is no need to install a vibration generating apparatus, facilitating easy designing.

In image forming apparatus 1, after carrier is resupplied to each lower receiving section 95Y, 95M, 95C, or 95K (carrier receiving section), support leg portions 952 climb over step portions 962 at least once.

Consequently, carrier adhering to each lower receiving section 95Y, 95M, 95C, or 95K is reliably shaken off by vibration.

Furthermore, in image forming apparatus 1, support leg portions 952 and step portions 962 do not overlap each other when any one of the plurality of lower receiving sections 95Y, 95M, 95C, and 95K (carrier receiving sections) is located at the carrier falling position.

Consequently, the state of carrier distributing member 95 during carrier resupply is stabilized, enabling lower receiving sections 95Y, 95M, 95C, and 95K to reliably receive falling carrier.

Although the invention made by the present inventors has been described in detail above based on an embodiment, the present invention is not limited to the above-described embodiment, and alterations are possible without departing from the spirit of the present invention.

For example, control section 100 may make carrier distributing member 95 rotate at the time of no carrier being resupplied (for example, in the embodiment, each time image formation for 250 sheets has been achieved) to generate vibration. Consequently, carrier adhering to lower receiving sections 95Y, 95M, 95C, and 95K is further reliably shaken off and supplied to developing sections 81Y, 81M, 81C, and 81K.

The embodiment disclosed herein is a mere exemplification in all respects and is not intended to limit the present invention. The scope of the present invention is indicated not by the above description but by the appended claims, and is intended to include all of alterations within a meaning and a scope equivalent to the appended claims.

What is claimed is:

1. An image forming apparatus comprising:

a plurality of developing sections that develop electrostatic latent images respectively formed on a plurality of photoconductors using a developer including a corresponding color toner and carrier to form a toner image;

a toner supply section that supplies the corresponding color toner to the plurality of developing sections;

a carrier supply section provided separately from the toner supply section, the carrier supply section supplying carrier to the plurality of developing sections; and a control section that controls an operation of the carrier supply section, wherein the carrier supply section includes:

a carrier housing section that houses the carrier;

a carrier distributing section that receives a predetermined amount of carrier that has freely fallen from a carrier supply port of the carrier housing section and guides the predetermined amount of carrier to each of the plurality of developing sections;

a support frame section that slidably supports the carrier distributing section; and a vibration exciter section that vibrates the carrier distributing section.

2. The image forming apparatus according to claim 1, wherein the carrier distributing section has a cylindrical shape, and includes a plurality of carrier receiving sections formed on a same circle at an upper surface thereof and to be connected to the plurality of developing sections, respectively; and wherein at the time of carrier resupply, the control section makes the predetermined amount of carrier freely fall from the carrier housing section, and makes the carrier distributing section rotate on the support frame section so that the plurality of carrier receiving sections are sequentially moved to a position corresponding to the carrier supply port.

3. The image forming apparatus according to claim 2, wherein the control section makes the carrier distributing section rotate at the time of no carrier being resupplied.

4. The image forming apparatus according to claim 1, wherein on a lower surface of the carrier distributing section, a support leg portion that projects downward is formed;

wherein on a surface of the support frame section that slides relative to the carrier distributing section, a step portion is formed;

wherein the support leg portion and the step portion constitutes the vibration exciter section; and wherein along with rotation of the carrier distributing section during carrier resupply, the support leg portion climbs over the step portion, whereby vibration of the carrier distributing section is generated.

5. The image forming apparatus according to claim 4, wherein after carrier resupply to each of the plurality of carrier receiving sections, the support leg portion climbs over the step portion at least once.

6. The image forming apparatus according to claim 4, wherein the support leg portion and the step portion do not overlap each other when any one of the plurality of carrier receiving sections is located at a carrier failing position.

* * * * *